US006347582B1

(12) United States Patent
Jones

(10) Patent No.: US 6,347,582 B1
(45) Date of Patent: Feb. 19, 2002

(54) ROTARY IMPRINT PRINTING SYSTEM

(75) Inventor: Jackson Hacker Jones, Rochester, NH (US)

(73) Assignee: Heidelberger Druckmaschinen Heidelberg (DE)

( * ) Notice: Subject to any disclaimer, the term of this patent is extended or adjusted under 35 U.S.C. 154(b) by 0 days.

(21) Appl. No.: 09/335,369

(22) Filed: Jun. 17, 1999

(51) Int. Cl.[7] ..... B41L 47/50
(52) U.S. Cl. ..... 101/91; 101/377; 101/52
(58) Field of Search ..... 101/52, 74, 76, 101/91, 92, 103, 109, 368, 372, 373, 377, 380, 381, 401.4, 401.6, 216

(56) References Cited

U.S. PATENT DOCUMENTS

| | | | | | |
|---|---|---|---|---|---|
| 1,196,729 | A | * | 8/1916 | Barroll | 101/52 |
| 1,791,451 | A | * | 2/1931 | Kohler | 101/91 |
| 2,204,971 | A | | 6/1940 | Rouan et al. | 101/110 |
| 2,816,503 | A | * | 12/1957 | Heil | 101/91 |
| 3,181,456 | A | * | 5/1965 | Pannier et al. | 101/91 |
| 3,401,627 | A | * | 9/1968 | Sheriff | 101/52 |
| 3,878,780 | A | * | 4/1975 | Lotte | 101/119 |

FOREIGN PATENT DOCUMENTS

| | | |
|---|---|---|
| DE | 567 173 | 12/1932 |
| DE | 1 105 888 | 5/1961 |
| DE | 1 801 638 | 6/1970 |
| DE | 4031964 A1 | 4/1992 |

* cited by examiner

*Primary Examiner*—Leslie J. Grohusky
(74) *Attorney, Agent, or Firm*—Herbert L. Lerner; Laurence A. Greenberg; Werner H. Stemer

(57) ABSTRACT

The imprint printing system allows imprinter head changes on the run. A printing roller, either an offset or a flexo printing roller, has an axial channel in which one or more imprinter heads are disposed. The imprinter heads can be selectively raised out of the channel so that the print surface projects radially above the periphery of the printing roller. In a variation of the basic concept, the imprinter heads are also axially movable along the axial channel. The individual heads can thereby be brought into a printing section defined by the location at which the product is to be imprinted. The respective imprinter head is raised for printing only in the printing section, while the other heads are withdrawn into the channel.

17 Claims, 6 Drawing Sheets

ROTARY IMPRINT PRINTING SYSTEM

BACKGROUND OF THE INVENTION

1. Field of the Invention

The invention lies in the printing field. Specifically, the invention relates to a device for imprint printing with a rotary printing press.

Rotary printing presses are conventionally used to imprint small area images in otherwise finished stock. It is often necessary to imprint a small area message or image onto a partial batch of product within a larger print job. For instance, it may be necessary to personalize, batch-code, bar-code, or date a given advertising flyer or a packaging cardboard prior to final post-press finishing.

The rotary printing press for imprint printing may be a flexo printer, an offset printer, a letterpress, or a lithographic printer. The product may be processed in a web which is cut and folded subsequent to the final imprint, or it may be processed in sheets. The different machines are referred to as web-fed rotary printing presses and sheet-fed rotary printing presses.

Depending on the number of partial batches into which the complete batch is divided, i.e., depending on how many different imprints are required, it is necessary to stop the press each time and change the imprinter head and, if present, the printing plate. The stoppage and the changeover lead to considerable time losses. Also, the make-ready and the new startup lead to product waste.

2. Description of the Related Art

German patent application No. DE 40 31 964 A1, for instance, describes a rotary printing device with which small area print images are imprinted on a paper web. The device is essentially a web-fed letterpress system with an impression roller carrying the image base body, a counter-pressure roller, an inking roller, and a transport system. The impression roller is formed with an axial groove in which the imprinter head is attached. The imprinter head may be shifted axially in the groove so as to place the imprint image laterally on the product. It is also possible to attach several imprinter heads along the groove. This makes it possible to imprint two or more signatures parallel to each other, or place more than one imprint on the same signature. The inking system includes an ink pan with ink, an ink pickup roller which is partially immersed in the ink, and an inking roller in contact with the pickup roller and the imprinter head. The inking roller thus transfers the ink from the pickup roller to the imprinter head which, in turn, transfers the ink onto the product as it travels through the roller nip between the impression roller and the counterpressure roller.

If it becomes necessary to change the imprint image, the transport system must be stopped and the imprinter head must be changed over to the new image. This causes undesireable stoppage and waste product.

SUMMARY OF THE INVENTION

It is accordingly an object of the invention to provide a rotary imprint printing system, which overcomes the above-mentioned disadvantages of the heretofore-known devices and methods of this general type and which allows on-the-fly changeover to a new imprint image and, as a result, provides for substantially decreased downtime, reduced product spoilage, and lower overall printing machine cost.

With the foregoing and other objects in view there is provided, in accordance with the invention, a rotary imprint printing system, comprising:

a printing roller having a periphery and an axial channel formed in the periphery;

an imprinter head disposed in the channel, the imprinter head having a print surface substantially parallel with the periphery of the printing roller, the imprinter head being supported in the channel to be radially extendible out of the channel such that the print surface projects radially beyond a plane defined by the periphery of the printing roller.

In accordance with an added feature of the invention, the printing roller has a given axial length and the axial channel extends substantially entirely along the given axial length.

In accordance with an additional feature of the invention, a pressure fluid system is partly disposed in the channel radially below the imprinter head for selectively raising and lowering the imprinter head.

In accordance with another feature of the invention, the pressure fluid system comprises an inflatable member, such as a bladder or a bellows, disposed radially below the imprinter head in the channel, a fluid control device for controlling a selective inflation and deflation of the inflatable member, and fluid lines fluidically connecting the inflatable member with the fluid control device.

In accordance with a further feature of the invention, the imprinter head is one of a plurality of imprinter heads each disposed to individually and selectively project from the periphery of the printing roller, and including a pressure fluid system for selectively raising and lowering each of the plurality of imprinter heads, the pressure fluid system including a plurality of inflatable members each disposed radially below a respective the imprinter head in the channel, a fluid control device for controlling a selective inflation and deflation of each of the plurality of inflatable members, and fluid lines fluidically connecting the inflatable members with the fluid control device.

In accordance with again an added feature of the invention, the imprinter heads are all disposed to axially travel along the axial channel and assume any of a number of defined positions along the axial channel.

In accordance with again an additional feature of the invention, the axial channel has a bottom and sidewalls, the sidewalls having recessed grooves formed therein, and including a carriage supporting the imprinter head axially shiftably within the axial channel along the recessed grooves.

In accordance with again another feature of the invention, the recessed grooves form cam tracks defining a radial position of the carriage, the cam tracks varying a radial location thereof along an axial extent of the axial channel.

In accordance with again a further feature of the invention, the axial channel is divided into three sections along an axial extent thereof and each imprinter head of the plurality of heads is disposed to be selectively transported into any of the three sections.

In accordance with yet another feature of the invention, the sections include a waiting section in which the print heads are disposed in a retracted position prior to an active printing state thereof, a printing section into which each of the imprinter heads is movable from the waiting section and in which the respective printing surface projects axially beyond the periphery of the printing roller, and a discharge section into which the imprinter heads are movable from the printing section.

In accordance with an advantageous feature of the invention, the imprint printing machine is a flexo printer. The print surface is thus a raised printing surface for letterpress printing, and the system includes a counterpressure roller disposed in a nipping relationship with the printing roller and forming a nip adapted to transport a product to be imprinted between the printing roller and the counterpressure roller.

In accordance with a concomitant feature of the invention, system is an offset printing system and the imprinter head carries an offset printing plate defining the print surface.

Three primary advantages that are obtained with the novel system become immediately evident:

1. Eliminate the need for free-standing imprint.
2. Increase productivity with on the run head changes.
3. Reduce overall press purchase price.

Other features which are considered as characteristic for the invention are set forth in the appended claims.

Although the invention is illustrated and described herein as embodied in a rotary imprint printing system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
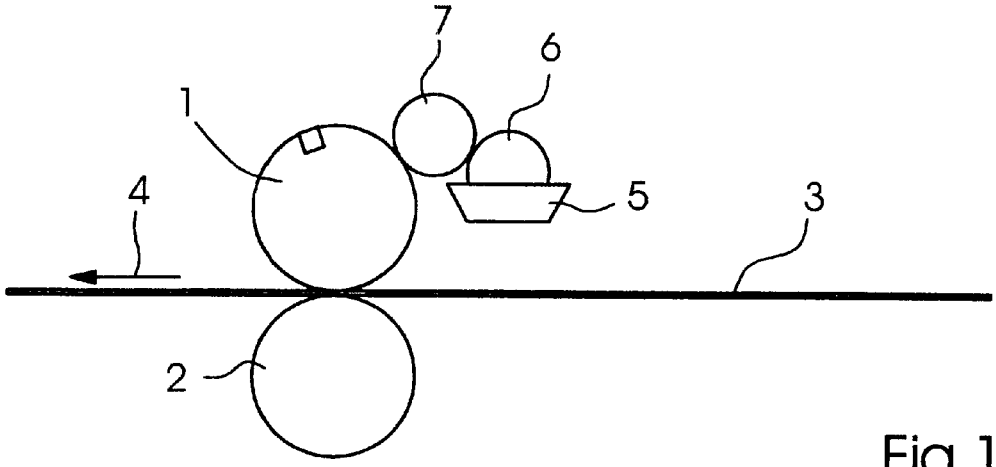
FIG. 1 is a diagrammatic side view of a rotary letterpress imprint printing machine.

Referring now to the figures of the drawing in detail and first, particularly, to FIG. 1 thereof, there is seen a diagrammatic side-elevational view of a first embodiment of the invention. The first embodiment prints in letterpress direct impression print. The image impression body is carried directly on an imprinter head which will be described in detail in the following text. The imprinter head is carried on an impression roller 1. The impression roller 1 and a counterpressure roller 2 form a nip through which a web 3 travels along a web travel direction 4. Inking is effected by an ink train formed by an ink fountain 5 which supplies a fountain roller 6 with ink. The fountain roller 6 transfers its ink to an inking roller 7. It will be understood that several auxiliary devices that are not essential to an understanding of the invention have been omitted from the ink train for diagrammatic clarity, such as ink fountain blades, an ink ductor roller, a vibrator roller and a rider roller.

The printing process is a conventional letterpress relief process: The imprinter head protrudes slightly outside the peripheral surface of the impression roller 1. When the imprinter head enters the nip formed between the rollers 1 and 7, the raised image portions of the imprinter head come into contact with the ink film on the inking roller 7 and the imprinter head is thereby inked. On coming into contact with the product (e.g. paper) forming the web 3 that travels through the printing nip between the rollers 1 and 2, the ink is transferred from the imprinter head to the product.

Figure 2:
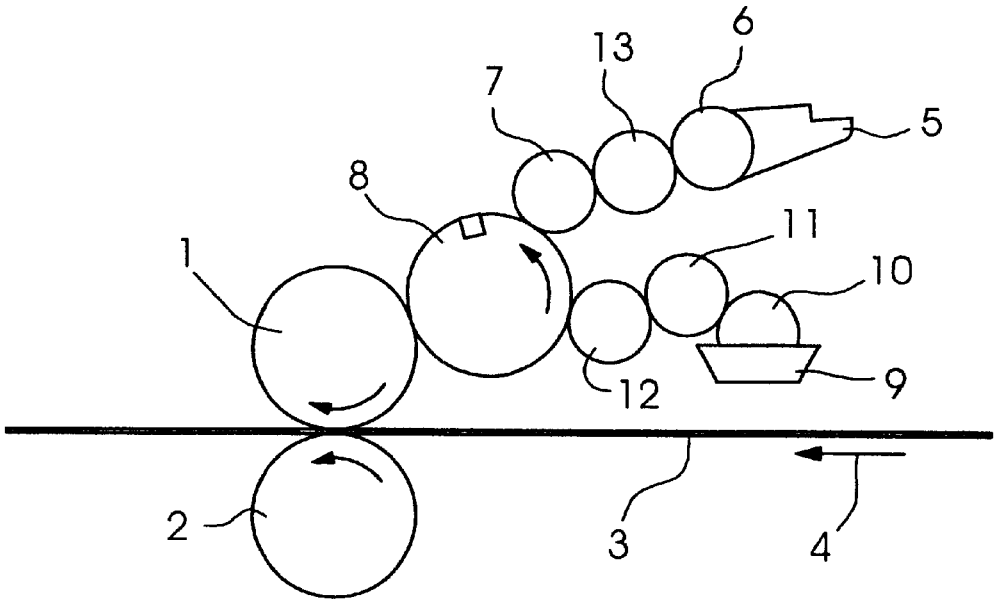
FIG. 2 is a is a diagrammatic side view of a rotary offset imprint printing machine.

The system may also be used in the context of an offset printing process. With reference to FIG. 2, the offset system comprises a blanket roller 1 which, together with the counterpressure roller 2 forms the nip through which the web 3 travels along the web travel direction 4. In the offset system, the imprinter head (which carries an offset printing plate) is disposed on an imprinter cylinder 8 (also referred to as the plate cylinder). The dampening of the plate is effected by a water train which includes a water pan 9, a water pickup roller 10, a transfer roller 11, and a dampening roller 12. In the alternative, the water train may be a spray dampener which, instead of the water pan 9 and the water pickup roller 10 sprays water onto the transfer roller 11 or directly onto the dampening roller 12. The periphery of the dampening roller 12 is spaced from the imprinter cylinder 8 by a spacing which ensures that only the printing plate carried on the imprinter head comes into contact with the water film on the dampening roller 12. The plate surface projects radially from the peripheral level of the dampening roller.

The printing process is a conventional offset print: The printing plate is divided into hydrophilic and hydrophobic areas that represent the image to be printed. The dampening roller 12 first wets the printing plate. The water molecules adhere only to the hydrophilic areas. Next the printing plate travels by the ink form roller 7 and comes into contact with the ink layer that is carried on the ink form roller 7. Since ink and water do not mix and the hydrophilic surfaces are covered with a water film, the ink will adhere only to the oleophilic surfaces on the printing plate. An ink train assures a constant supply of ink to the roller 7. The ink train, similarly to FIG. 1, includes an ink source comprising an ink fountain 5 and a fountain roller 6, as well as an ink transfer roller 13 that transfers the ink from the fountain roller 6 to the ink form roller 7.

The rollers are either driven in common via a corresponding gear or mechanical linkage system, or by individual speed-matched motors. Such motors are now used, for instance, in rotary printing presses available from Heidelberg Web Systems of Dover, New Hampshire.

Figure 3:
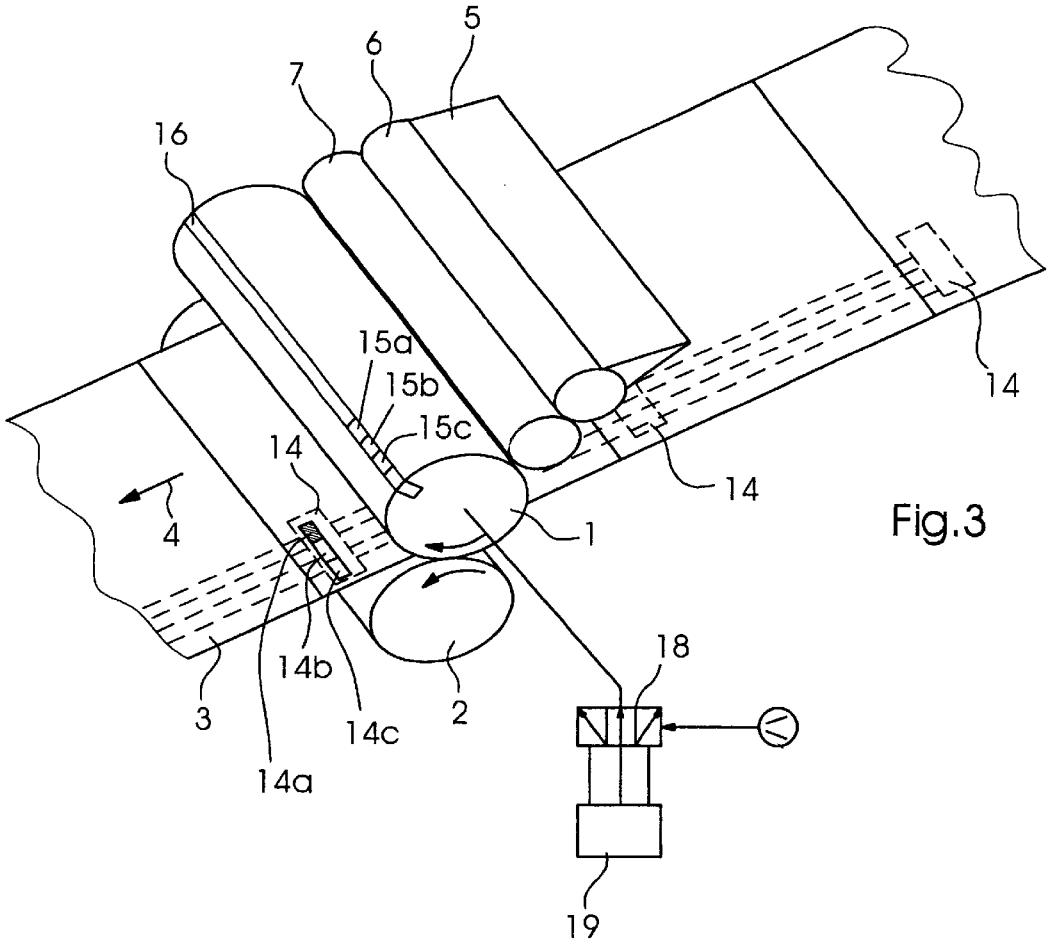
FIG. 3 is a partly schematic, perspective view of a first embodiment of the imprint printing machine according to the invention with three fixed-position imprinter heads.

The imprinter system will now be explained with reference to the simplified illustration in FIG. 3. To begin with, however, it is noted that the system shown in FIG. 3 is substantially simplified in terms of the number and detail of the illustrated members. For instance, any web aligners, web weave control systems, nipping control devices, or printing pressure adjustment systems are not shown. Those of skill in the pertinent art, however, will be able to make and use the novel system on the bases of their skill in the field.

The web 3 has predetermined imprint areas 14, i.e., areas of the main print image that are ready for the specialized, customized imprint. In a most simple embodiment of the invention, the imprint areas 14 are subdivided into a plurality of imprint zones 14*a*, 14*b*, 14*c*. A first batch of the running print job may be imprinted with a given imprint at the imprint zone 14*a*, a second batch may be imprinted at the imprint zone 14*b*, and a third batch may be imprinted at the imprint zone 14*c*. The number of imprint zones is not limited, but it will logically correspond to the number of imprinter heads that are available. The imprinter heads are disposed at sections 15*a*, 15*b*, and 15*c* axially defined within a channel 16 formed in the roller 1. The section 15*a* thereby corresponds to the zone 14*a*, the section 15*b* corresponds to the zone 14*b*, and the section 15*c* corresponds to the zone 14*c*. In other words, the exemplary embodiment of FIG. 3 has three imprinter heads for three different imprint zones. Each of the imprinter heads at the sections 15*a*, 15*b*, and 15*c* can be individually raised so as to print in the respective section. For that purpose, a pneumatic or hydraulic pressure source is connected to the individual imprinter heads via a valve 18. The number of positions of the valve 18 will also correspond to the number of the imprinter heads. Typically, each of the imprinter heads will be triggered when the other imprinter heads are inactive. However, it is also possible to trigger more than one head at a time (i.e., imprint more than one of the imprint zones on a single signature). The pressure distribution is controlled by a control system 19 that is connected to the valve 18. In a simple embodiment, the control system 19 will be an array of switches, a multiple position selector switch, or an electronic control circuit.

The mode of operation of the system of FIG. 3 is as follows: as the web 3 travels along its web travel direction 4 and the rollers 1 and 2 rotate at a corresponding peripheral speed, one of the imprinter heads—for instance in the section 15*a*—is raised up. The head at section 15*a* is thus inked and the imprint is effected in the zone 14*a*. If a different imprint is now desired at the zone 14*b*, the imprinter head at the section 15*a* is lowered, the imprinter head at the section 15*b* is raised, and the zone 14*b* is imprinted. This is continued until the necessary batch number has been reached and a different imprint is desired. This simple explanation makes it clear that the imprinter head change of this invention is on the fly. It is not necessary to stop the press for each change. Instead the entire print job with a plurality of different imprints can be processed without even once stopping the web.

Figure 4:
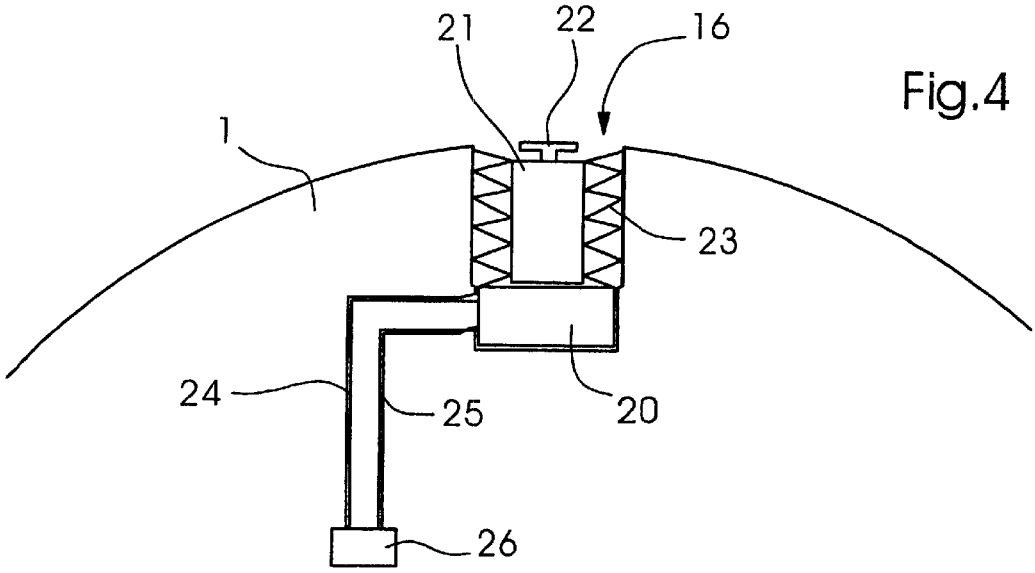
FIG. 4 is a partial diagrammatic radial section through an impression roller with an imprinter head that is raisable with a fluid-charged bladder or bellows.

A detailed description of the structure of the imprinter heads and the trigger mechanism will now be provided with reference to FIG. 4. An inflatable member 20 (e.g. pneumatic or hydraulic bladder or bellows chamber) is disposed on the floor of the axial channel 16 formed in the cylinder 1. The bladder 20 carries an imprinter head 21 that projects radially outward from the bladder 20 and, in turn, carries a raised printing surface 22 (letterpress print system) or a small offset plate 22 (offset print system); hereinafter all referred to as a "print surface 22". Annular compression packs 23 fulfill a dual purpose. First, they lock the print head 21 against a movement thereof in the axial and circumferential directions (the non-radial orthogonal directions). Second, the compression packs 23 may also be used to radially bias the imprinter head inside the channel 16 so that, in its non-triggered position, the print surface 22 does not project beyond the periphery of the cylinder 1. The bias force must be at least slightly stronger than the expected centrifugal force (depending on the maximum printing speed and, accordingly, the angular speed of the roller 1).

Figure 5:
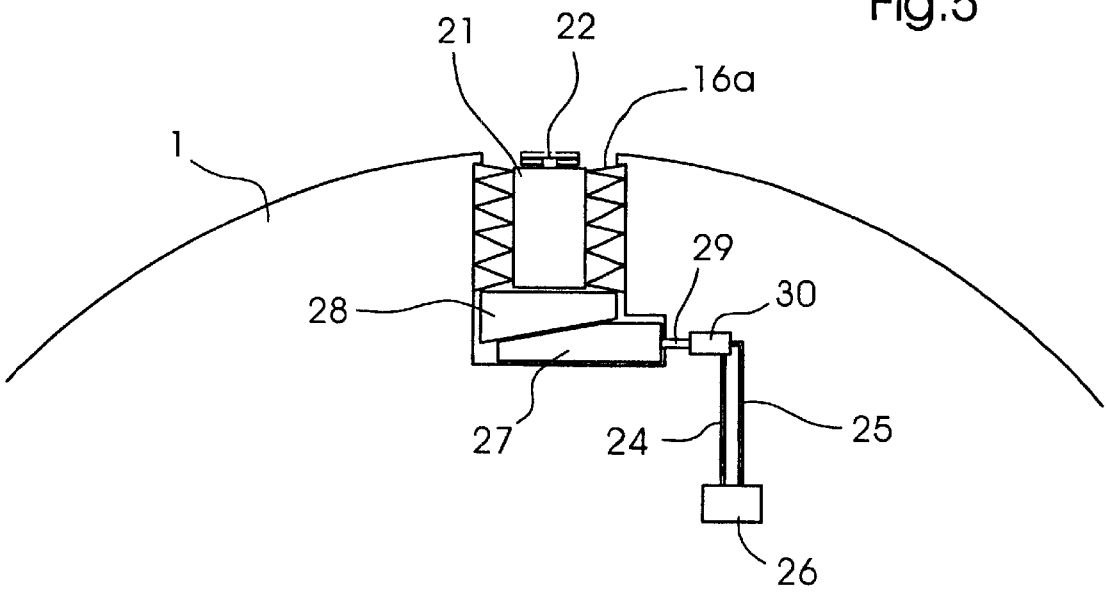
FIG. 5 is a partial diagrammatic radial section through an impression roller with an imprinter head that is raisable with a displacement wedge.

As indicated in FIG. 4, the side walls of the channel 16 are formed so as to obliquely lean towards one another towards the periphery of the roller 1. This trapezoidal sectional arrangement assures that the imprinter head 21 and the spring pack 23 are safely retained inside the channel 16. It further shows that the imprinter head assembly is laterally inserted in the channel 16 from one of the end faces of the roller 1. An alternative embodiment of the retention structure is illustrated in FIG. 5. There, the head assembly is retained by two mutually opposite ledges 16*a* formed at the channel edge closest to the periphery of the roller 1. In other words, the outermost wall layer of the roller 1 is extended by a few millimeters into the channel and to a depth (thickness) of a few millimeters to form the retaining ledges 16*a*.

Returning once more to FIG. 4, the bladder 20 is connected to at least two fluid lines, namely a charge line 24 and a bleed line 25. The fluid lines 24 and 25 are controlled by a chamber control device 26. The chamber control device 26 may be disposed inside the cylinder 1 or it may be disposed outside. In the former case, only a relatively simple leadthrough through the rotary bearing of the cylinder 1 will be necessary for the hydraulic or pneumatic pressure fluid. In addition, the control device 26 would then best be an electrically triggered switch. It is also possible, however, to provide a self-contained system inside the cylinder 1 without any fluid connection to the outside of the cylinder. For that purpose, the control device 26 would itself be a pumping device with a fluid reservoir. Only an electrical connection must thereby be led through to the outside of the cylinder 1. If the chamber control device 26 is disposed externally of the rotating cylinder, it is necessary to conduct several fluid lines through the rotary bearing. At a minimum, six fluid leadthroughs would be provided in the exemplary embodiments of FIG. 3, for instance, namely two for each of the three imprinter heads. Pressure fluid leadthroughs and electrical leadthroughs from stationary frames to rotating cylinders are well known to those of skill in the printing arts and they will, therefore, not described in detail herein.

The embodiment of FIG. 5 is similar to that of FIG. 4. Here, however, the imprinter head 21 is selectively raised and lowered by the interaction of two wedges 27 and 28. The wedge 27 is movable transverse to the longitudinal extent of the channel 16, i.e. from right to left in the figure. The wedge 27 is moved by a piston 29 of a pneumatic or hydraulic cylinder 30. Similarly to the bladder 20, the cylinder 30 is connected to a control device 26 (here, a cylinder control device) via fluid lines 24 and 25. As the wedge 27 is moved to the left when the piston 29 is extended, the imprinter head 21 is radially raised out o f the channel 16. When the print surface 22—again, this may be a raised printing surface for flexo printing or an offset plate—is sufficiently raised above the peripheral surface plane of the cylinder 1, the imprinter head becomes active and prints until it is lowered back into the channel 16.

The extent by which the print surface 22 is raised above the peripheral plane is a function of the wedge angle and the extension of the piston 29. The radial displacement d of the imprinter head, i.e. the distance between its inactive position shown in FIG. 5 and its active, extended position, can be expressed as $d=x\cdot\sin\alpha$, where x is the travel of the piston 29 and $\alpha$ is the wedge angle of the wedge 27 or 28, whichever is greater, relative to the horizontal. Horizontal, in this context, is understood as the orthogonal plane relative to any radial beam originating at the rotary axis of the cylinder 1.

Figure 6:
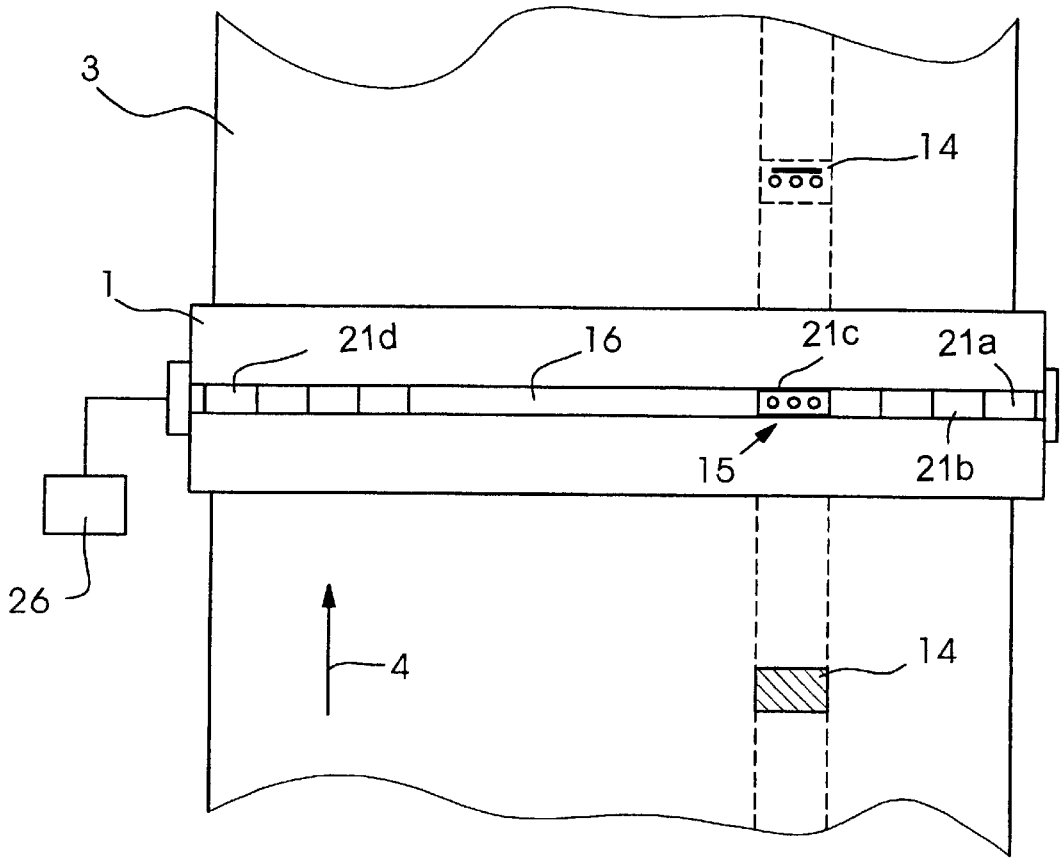
FIG. 6 is a top plan view onto an imprinter roller of an imprinter printing system according to the invention.

Referring now to FIG. 6, there is shown a second embodiment of the invention. The imprint printing machine of the second embodiment is adapted to print with a plurality of imprinter heads 21*a*, 21*b*, 21*c*, and 21*d* to a single imprint zone 14 on the web 3. For that purposed, all of the imprinter heads 21*a*, 21*b*, 21*c*, and 21*d* are first disposed in their standby positions at the left-hand side of FIG. 6. As the respective imprinter head is needed for print, it is transported across the channel 16 to the section 15. There, the imprinter head 21*a*, 21*b*, 21*c*, and 21*d* is axially locked in place and raised so as to become active. When the entire batch has been printed, the respectively active imprinter head is lowered in to the channel 16, it axially unlocked, and transported into the inactive positions on the right-hand side of FIG. 6. As illustrated, the imprinter heads 21*a* and 21*b* have already finished their print assignment, the imprinter head 21*c* is currently printing, and the fourth imprinter head 21*d* is in its waiting position. Although not shown in FIG. 6, only the printing surface of each imprinter head 21*a*, 21*b*, 21*c*, and 21*d*, respectively, are raised above the peripheral plane of the impression roller 1.

The second embodiment is simplified relative to the first embodiment with the fixedly assigned imprinter heads in that only one lifting system (bladder or bellows 20, or wedge 27) is required. The lifter is thereby disposed at the section 15 and is triggered only when a respective imprinter head has been transported into the section 15 along the axial channel 16. On the other hand, the system is more complicated in that, here, the imprinter heads must be transported across the channel 16 and locked into place at the section 15. Various transport systems are available for the axial transport. For instance, a spindle drive may be provided, driven either with a fluid motor or with an electric motor. A carriage linear bearing may also be provided with a hydraulic or pneumatic fly-across drive.

Figure 7:
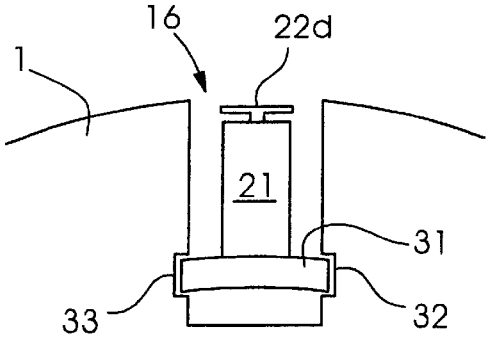
FIG. 7 is a side view of an imprinter head disposed in a cam groove channel.

FIG. 7 illustrates the imprinter head 21 in its waiting position (far left hand in FIG. 6). The imprinter head 21 is drawn back into its inactive position. The imprinter head 21 is disposed on a carriage 31 which can be axially moved along the channel 16 in recess grooves 32 and 33. The placement of the grooves 32 and 33 relative to the peripheral plane of the roller 1 ensures that the imprinter head 21 is locked in its inactive position.

Figure 8:
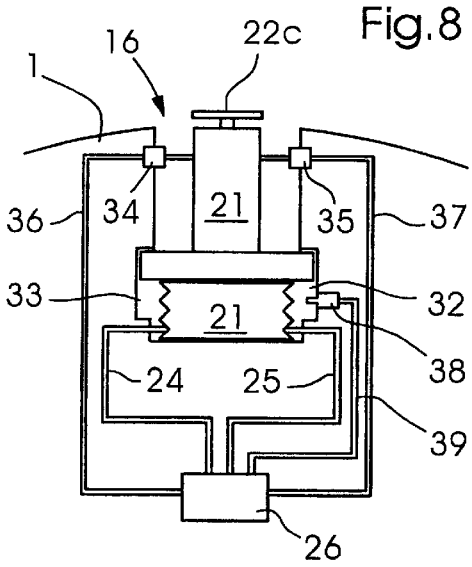
FIG. 8 is a diagrammatic side view of a similar imprinter head with a corresponding fluid diagram.

Reference will now be had to FIG. 8, which illustrates the imprinter head 21 in the section 15 and raised to be the active imprinter head. There is provided a bellows 20 (or a bladder 20 as illustrated in FIG. 3, or a wedge system as illustrated in FIG. 4) in the section 15 so as to allow the imprinter head 21 to be selectively raised at that position. The bellows 20 is fluidically connected to the control device 26 via fluid lines 24 and 25. Two pistons 34 and 35 are provided at the axially upper end of the channel 16. The pistons 34 clamp the imprinter head 21, once it is raised, so as to prevent a circumferential shift. The pistons 34 and 35 are also controlled by the control device 26 and for that purpose they are fluidically connected via fluid lines 36 and 37, respectively. During the print, the imprinter head 21 is subjected primarily to circumferential shifting forces, which are compensated by the pistons 34 and 35, and to radial impression forces, which are compensated by the counter-pressure provided by the bellows 20 and the centripetal force caused by the rotation of the roller 1.

As noted above with reference to FIG. 7, the axial recess grooves 32 and 33 hold the carriage 31 and the imprinter head 21 down in the channel 16. For that purpose, the recess grooves 32 and 33 are widened in the section 15 so as to allow the imprinter head to be appropriately raised for printing. Due to the fact that the grooves 32 and 33 are widened only in the section 15, it is assured that the imprinter head 21 does not axially shift once it is raised into its active position. When the head 21 flies across the channel 16, however, it must be stopped in the section 15 before it can be raised. A piston 38 with a pawl or a stop bolt is provided for that purpose. The piston 38 is also fluidically connected to the fluid control device 26 via a fluid line 39.

Figure 9:
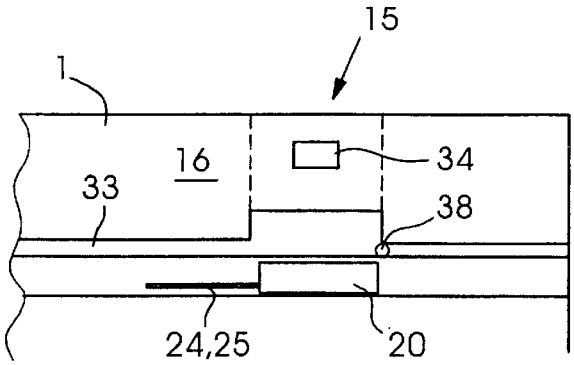
FIG. 9 is a longitudinal sectional view of an exemplary cam guide groove in a sidewall of an imprinter head channel.

FIG. 9 illustrates the recess groove 33 of FIGS. 7 and 8 in a plan view. It will be understood that the groove 32 is cut mirror-symmetrical to the groove 33. As indicated, the fluid lines 24 and 25, as well as other lines, may advantageously be laid out on the floor of the channel 16.

Figure 10:
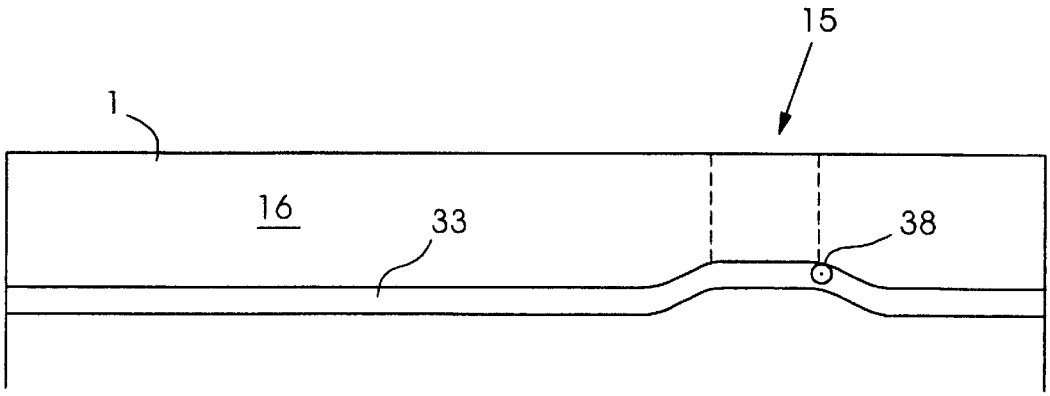
FIG. 10 is a similar view of an alternative embodiment of the cam guide groove.

Referring to FIG. 10, a particularly simple fly-across system is provided in which the imprinter head 21 is raised by an appropriately configured camming system. The recess grooves 32 and 33 act as cam tracks and the carriage 31 is the cam. The grooves 32 and 33 hold the imprinter heads 21 in the lowered, inactive position along the entire axial extent of the impression roller 1, except for the active section 15. There, the cam track raises the imprinter head 21 to become active. When the respective imprinter head 21 is finished with its batch within the print job, it is transported off to the right, whereby it is once more lowered into the channel 16 and the section 15 is ready to receive a further imprinter head 21 for a further batch.

Figure 11:
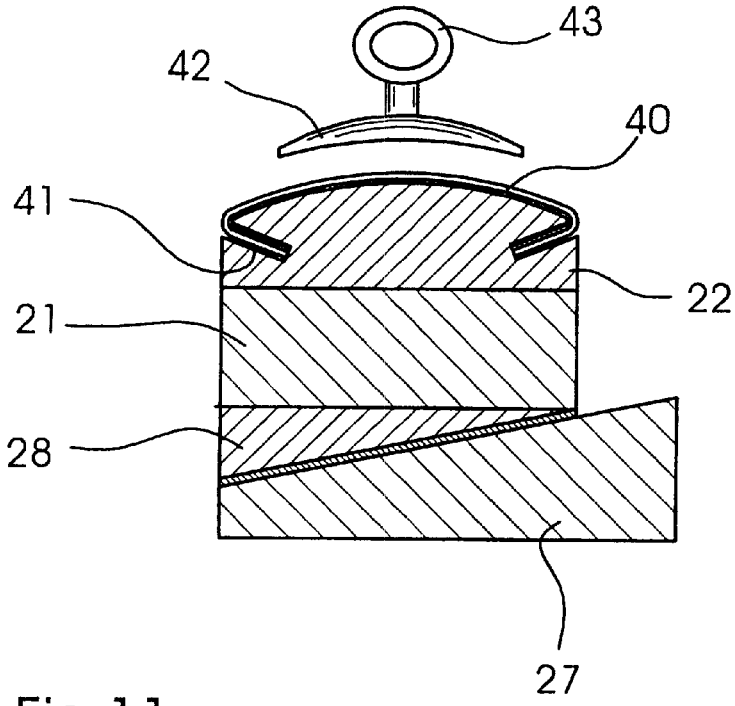
FIG. 11 is a side elevational view of an imprinter print head with a wedge lifter and an offset printing plate.

Referring now to FIG. 11, the imprinter print head may carry a printing plate 40. Similarly, to a conventional printing plate lock, the head 22 is formed with narrow slots 41 for locking the mini-plate 40 in place. The plate 40 can be carried attached to a suction cup 42 with a handle 43.

Figure 12:
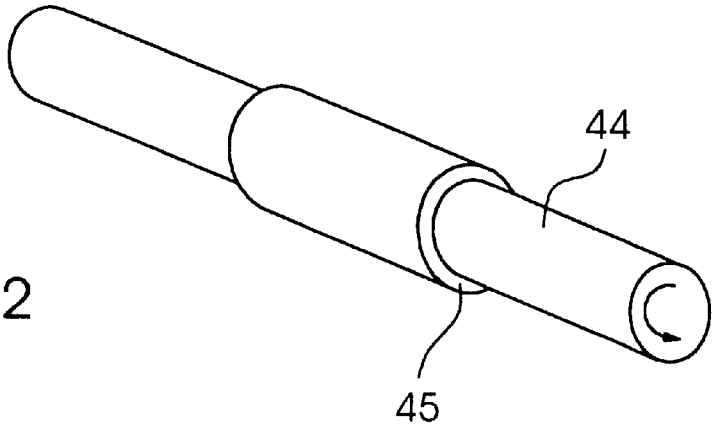
FIG. 12 is a perspective view of a camming sleeve of a linear bearing for supporting and moving the imprinter head within a channel.

Referring now to FIG. 12, the imprinter head may be supported and moved within the channel on a linear bearing 44. In a preferred embodiment, the linear bearing rod 44 is rotatably supported and it is formed as a cam shaft with at least one cam lobe 45. When the rod 44 is rotated while the imprinter head is disposed at the lobe 45, the head is cammed upwardly into its active position. The lobe 45 may be integrally formed with the rod or it may be a sleeve that is slipped onto the rod 44.

In closing, it should be understood from the foregoing description that various combinations of the exemplary implementations of the novel concept are possible. Also, the invention is not limited to the specific embodiments illustrated and the details that are shown. Various modifications and structural changes may be made in the invention without departing from the concept of the invention and within the scope and range of equivalents of the claims. More specifically, the invention has been described as a free-standing imprint system. However, it is equally applicable to its integration in a complete printing machine, whether it is a web-fed printing machine or a sheet-fed printing machine. Here, therefore, the main printing machine would provide for the master image(s) and the auxiliary imprint printer provides for the imprint which can be varied on the fly without interrupting the master print. Furthermore, the imprint printer can also be provided as a two-sided imprint system, i.e. a system where the web is simultaneously imprinted on both sides.

I claim:

1. A rotary imprint printing system, comprising:

a printing roller having a periphery and an axial channel formed in said periphery;

an imprinter head disposed in said channel, said imprinter head having a print surface substantially parallel with said periphery of said printing roller, said imprinter head being supported in said channel to be radially extendible out of said channel such that said print surface projects radially beyond a plane defined by said periphery of said printing roller; and a pressure fluid system filled with a hydraulic pressure fluid and partly disposed in said channel radially below said imprinter head for selectively raising and lowering said imprinter head, and including an inflatable member selected from the group consisting of a bladder and a bellows disposed radially below said imprinter head in said channel, a fluid control device for controlling a selective inflation and deflation of said inflatable member, and fluid lines fluidically connecting said inflatable member with said fluid control device.

2. The rotary imprint printing system according to claim 1, wherein said printing roller has a given axial length and said axial channel extends substantially entirely along said given axial length.

3. The rotary imprint printing system according to claim 1, wherein said print surface is a raised printing surface for letterpress printing, and including a counterpressure roller disposed in a nipping relationship with said printing roller and forming a nip adapted to transport a product to be imprinted between said printing roller and said counterpressure roller.

4. A rotary imprint printing system, comprising:

a printing roller having a periphery and an axial channel formed in said periphery;

a plurality of imprinter heads each disposed in said channel, said imprinter heads each having a print surface substantially parallel with said periphery of said printing roller and being supported in said channel to be radially extendible out of said channel such that said print surface projects radially beyond a plane defined by said periphery of said printing roller and to individually and selectively project from the periphery of said printing roller;

a pressure fluid system for selectively raising and lowering each of said plurality of imprinter heads, said pressure fluid system including a plurality of inflatable members each disposed radially below a respective said imprinter head in said channel; and a fluid control device for controlling a selective inflation and deflation of each of said plurality of inflatable members, and fluid lines fluidically connecting said inflatable members with said fluid control device.

5. The rotary imprint printing system according to claim 4, wherein said printing roller has a given axial length and said axial channel extends substantially entirely along said given axial length.

6. The rotary imprint printing system according to claim 4, wherein said print surface is a raised printing surface for letterpress printing, and including a counterpressure roller disposed in a nipping relationship with said printing roller and forming a nip adapted to transport a product to be imprinted between said printing roller and said counterpressure roller.

7. A rotary imprint printing system, comprising:

a printing roller having a periphery and an axial channel formed in said periphery;

a plurality of imprinter heads each disposed in said channel and having a print surface substantially parallel with said periphery of said printing roller, said imprinter heads each being supported in said channel to be radially extendible out of said channel such that said print surface projects radially beyond a plane defined by said periphery of said printing roller, to individually and selectively project from the periphery of said printing roller, and to axially travel along said axial channel and assume any of a number of defined positions along said axial channel; and a pressure fluid system filled with a hydraulic pressure fluid and partly disposed in said channel radially below said imprinter heads for selectively raising and lowering said imprinter heads.

8. The rotary imprint printing system according to claim 7, wherein said printing roller has a given axial length and said axial channel extends substantially entirely along said given axial length.

9. The rotary imprint printing system according to claim 7, wherein said print surface is a raised printing surface for letterpress printing, and including a counterpressure roller disposed in a nipping relationship with said printing roller and forming a nip adapted to transport a product to be imprinted between said printing roller and said counterpressure roller.

10. A rotary imprint printing system, comprising:

a printing roller having a periphery and an axial channel formed in said periphery, said axial channel having a bottom and sidewalls, said sidewalls having recessed grooves formed therein, and including a carriage;

an imprinter head axially shiftably supported by said carriage within said axial channel along said recessed grooves, said imprinter head having a print surface substantially parallel with said periphery of said printing roller, said imprinter head being radially extendible out of said channel such that said print surface projects radially beyond a plane defined by said periphery of said printing roller; and a pressure fluid system filled with a hydraulic pressure fluid and partly disposed in said channel radially below said imprinter head for selectively raising and lowering said imprinter head.

11. The rotary imprint printing system according to claim 10, wherein said recessed grooves form cam tracks defining a radial position of said carriage, said cam tracks varying a radial location thereof along an axial extent of said axial channel.

12. The rotary imprint printing system according to claim 10, wherein said printing roller has a given axial length and said axial channel extends substantially entirely along said given axial length.

13. The rotary imprint printing system according to claim 10, wherein said print surface is a raised printing surface for letterpress printing, and including a counterpressure roller disposed in a nipping relationship with said printing roller and forming a nip adapted to transport a product to be imprinted between said printing roller and said counterpressure roller.

14. A rotary imprint printing system, comprising:

a printing roller having a periphery and an axial channel formed in said periphery, said axial channel being divided into three sections along an axial extent thereof;

a plurality of imprinter heads each being disposed in said channel to individually and selectively project from the periphery of said printing roller to be selectively transported into any of said three sections, said imprinter heads each having a print surface substantially parallel with said periphery of said printing roller and being supported in said channel to be radially extendible out of said channel such that said print surface projects radially beyond a plane defined by said periphery of said printing roller; and a pressure fluid system filled with a hydraulic pressure fluid and partly disposed in said channel radially below said imprinter heads for selectively raising and lowering said imprinter heads.

15. The rotary imprint printing system according to claim 14, wherein said printing roller has a given axial length and said axial channel extends substantially entirely along said given axial length.

16. The rotary imprint printing system according to claim 14, wherein said print surface is a raised printing surface for letterpress printing, and including a counterpressure roller disposed in a nipping relationship with said printing roller and forming a nip adapted to transport a product to be imprinted between said printing roller and said counterpressure roller.

17. The rotary imprint printing system according to claim 14, wherein said three sections include a waiting section in which said imprinter heads are disposed in a retracted position prior to an active printing state thereof, a printing section into which each of said imprinter heads is movable from said waiting section and in which said respective printing surface projects axially beyond the periphery of said printing roller, and a discharge section into which said imprinter heads are movable from said printing section.

* * * * *